US006554680B2

(12) United States Patent
Abbondandolo

(10) Patent No.: US 6,554,680 B2
(45) Date of Patent: Apr. 29, 2003

(54) SNAP ON ACTION FIGURES

(76) Inventor: Robert Abbondandolo, 1921 SE. 1st Ter., Cape Coral, FL (US) 33990

( * ) Notice: Subject to any disclaimer, the term of this patent is extended or adjusted under 35 U.S.C. 154(b) by 0 days.

(21) Appl. No.: 09/749,860

(22) Filed: Dec. 29, 2000

(65) Prior Publication Data

US 2001/0001754 A1 May 24, 2001

(51) Int. Cl.[7] ..... A63H 3/00
(52) U.S. Cl. ..... 446/268; 446/28; 2/338
(58) Field of Search ..... 446/487, 901, 446/26, 28, 27; 40/538, 611, 657, 620, 622; 2/300, 322, 338, 311

(56) References Cited

U.S. PATENT DOCUMENTS 4,595,618 A * 6/1986 Caringer ..... 428/100
4,715,839 A * 12/1987 Ford et al. ..... 446/28
4,723,931 A * 2/1988 Allen et al. ..... 446/268
5,027,442 A * 7/1991 Taylor ..... 2/338
5,540,609 A * 7/1996 Hoag ..... 446/26
5,647,107 A * 7/1997 Brewster ..... 24/13.6
6,178,680 B1 * 1/2001 Sloot ..... 40/668
6,224,450 B1 * 5/2001 Norton ..... 446/28

* cited by examiner

*Primary Examiner*—Derris H. Banks
*Assistant Examiner*—Jamila O Williams
(74) *Attorney, Agent, or Firm*—Frank A. Lukasik

(57) ABSTRACT

The instant invention pertains to action figures having a female connection formed on the back and a belt or theme mounting having a plurality of male connectors. The action figures may pertain to a sport such as wrestling or baseball, or a super hero or other famous person. The action figure is connected to the belt for wearing a group of related action figures. A second embodiment consists of a theme mount such as a bat or hockey stick.

2 Claims, 2 Drawing Sheets

SNAP ON ACTION FIGURES

BACKGROUND

1. Field of the Invention

The present invention relates generally to toys and more specifically, to toy action figures that can be attached to a child's belt or otherwise mounted for convenience, display or decoration on theme mounts according to the intended use.

2. Prior Art

Toy action figures have become very popular with children in recent years particularly where they are created in the likeness of characters from popular movies, TV shows or books and comic books. It is implicit in the nature of an action figure that it would be used in games simulating the fictional exploits of said action figure. Children at play may have numerous figures at hand as they interact with each other and the environments in which the playing occurs. Presently, multiple action toys may be stored in their original packaging or other receptacles that may be provided for such a purpose. Children, however, as is often their nature, spread the parameters of their game-playing environments as far as they are permitted and as a result, misplace toys or find themselves too far from their main toy repository to easily carry needed toys with them.

SUMMARY OF THE INVENTION

In a first embodiment of the instant invention is an attachment means by which children can affix toy action figures to specially adapted belts or harnesses which they can safely wear while playing thereby having multiple toys at hand for immediate access and display. Such a function is analogous to the wearing of toy gun belts and holsters wherein the toys are both decorative and accessible to the child. In a second embodiment, the attachment means on the toy action figure is used to attach the toy to an ornamental or storage rack whereby it may be safely stored and/or displayed. Such ornamental racks could include, but not be limited to, sports themes, character themes or any other subject limited only by the imagination/resources available to the child.

DETAILED DESCRIPTION OF A PREFERRED EMBODIMENT

The instant invention pertains to toys in the general category of "Action Figures". These action toys may be sold as individual toy items or as a set pertaining to a movie, or a sport such as wrestling or baseball for example. The action figure can be anything from a super-hero, e.g. Batman, Superman, etc., or a sports figure, e.g. Sammy Sosa, Wayne Gretsky, etc. The child can "snap" these figures on the action figure belt and wear them, or may be displayed in their rooms on an appropriate display, e.g., a baseball bat, hockey stick, etc. The belt or display has a "male" stud and the action figures have a "female" snap-on socket on their backs.

Figure 1:
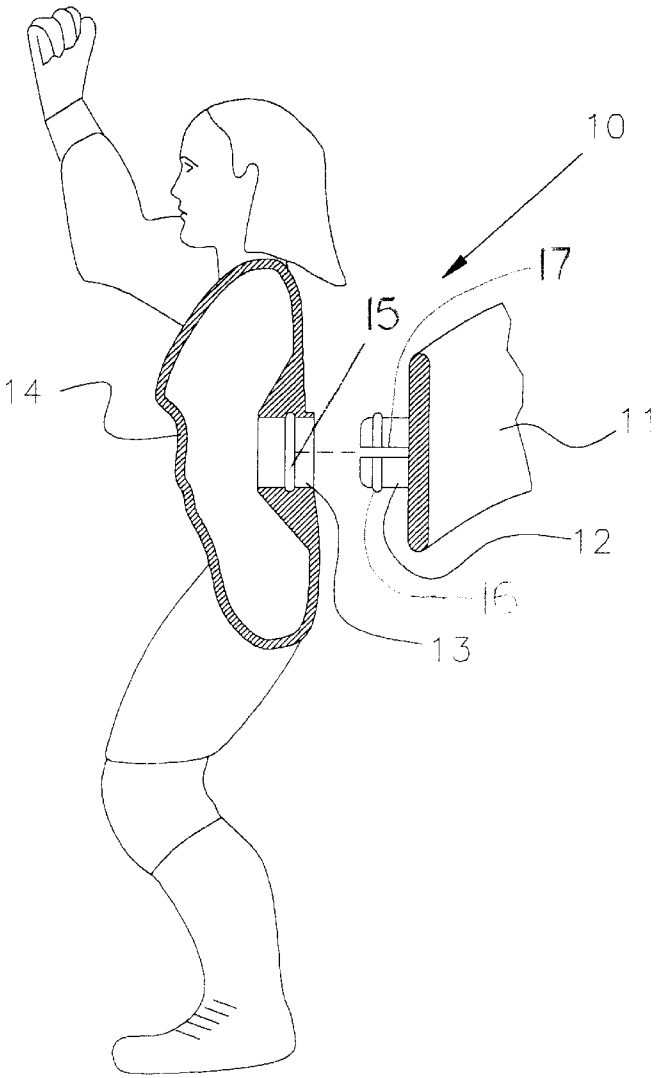
FIG. 1 is a side view, partly in section, of a typical action figure in accordance with the invention.

FIG. 1 depicts a side view, partially in section, of the action figure of the invention designated overall by the numeral 10. Also shown is the mounting of the male connector 12 in a child's toy belt 11. The action FIG. 10 has a female connection socket 13 in the center if its back. Plastic child's belt 11 is mounted with the male connection 12. In operation, action figure body 14 is simply pushed back until the female socket 13 snaps over the male connector 12, thus attaching the action FIG. 10 to the belt 11.

Figure 2:
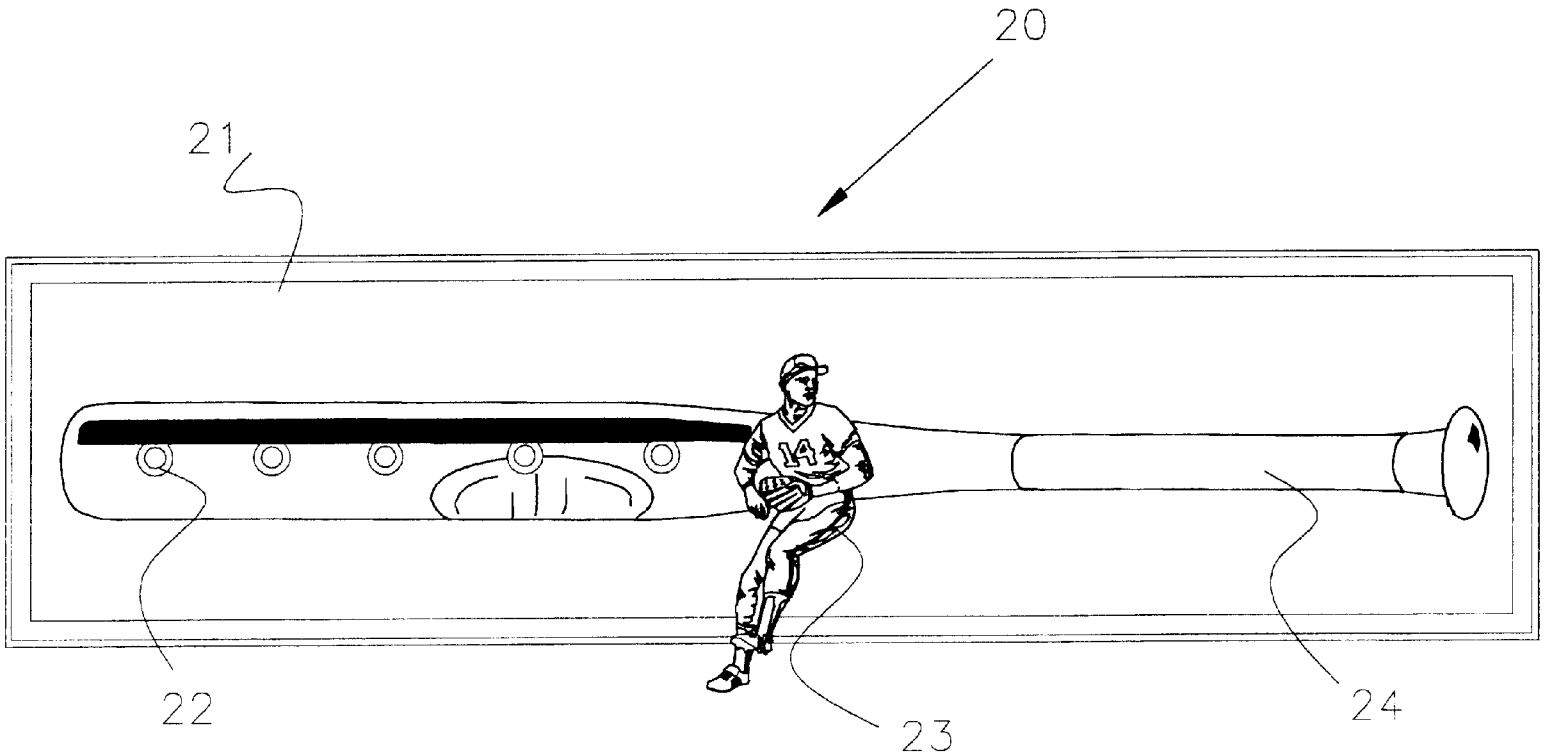
FIG. 2 is a front view of a second embodiment of the invention showing a typical "theme" display.

FIG. 2 depicts a second embodiment of the invention which consists of a baseball player action FIG. 23 mounted on a baseball bat 24. Wall plaque 21 is mounted with theme mount 20. The theme mount 20 has bat 24 permanently mounted on plaque 21 and a series of male connectors 22 mounted on bat 24 to which a theme action FIG. 23 is attached. The action FIG. 23 has a female socket 13 (not shown) mounted in a manner similar to the female socket 13 in action figure body 14.

As shown in FIG. 1, the female socket 13 consists of a hollow tube having a circular groove 15 at a midpoint of socket 13. When male connector 12 is inserted into socket 13, the circular ring 16, formed on connector 12 connects with the circular groove 15 and the two parts become locked in place. The slit 17 in connector 12 permits the split parts of the connector 12 to spring inwardly to fit within the socket 13 and spring back when the ring 16 mates with groove 15.

The connector 12 and socket 13 are the preferred means to fasten the action FIG. 10 to the belt 11 or the theme mount 20. Other fastening means are also contemplated.

While the principles of the invention have been described above in connection with specific embodiments of the invention, it is understood that these descriptions are made only by way of example and not as a limitation on the scope of the invention.

What is claimed is:

1. A combination of a toy action figure releasably attached for convenience, to a display belt, said combination comprising:

a toy action figure depicting a selected theme from a group including, sports, super heroes, and other famous persons, each of said action toy figures having a back, said back having a hole formed in said back and a female connection socket inserted and fastened in said back, said female connection socket having a circular groove formed therein, and a belt for mounting a collection of said action toy figures, said belt having a plurality of male connectors fastened thereto, said male connectors having a slit therein providing a spring action and a ring formed around the exterior periphery of said male connectors for mating with said circular groove formed in said female connection socket.

2. A combination of a toy action figure releasably attached for convenience, to a display mount, said combination comprising:

a toy action figure depicting a selected theme from a group including, sports, super heroes, and other famous persons, each of said action toy figures having a back, said back having a hole formed in said back and a female connection socket inserted and fastened in said back, said female connection socket having a circular groove formed therein, and a display mount for mounting a collection of said action toy figures, said display mount having a plurality of male connectors fastened thereto, said male connectors having a slit therein providing a spring action and a ring formed around the exterior periphery of said male connectors for mating with said circular groove formed in said female connection socket.

* * * * *